US006624562B2

(12) United States Patent
Uchida et al.

(10) Patent No.: US 6,624,562 B2
(45) **Date of Patent: *Sep. 23, 2003**

(54) COLOR CATHODE RAY TUBE HAVING AN IMPROVED ELECTRON GUN

(75) Inventors: Go Uchida, Mobara (JP); Shoji Shirai, Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/214,368

(22) Filed: Aug. 8, 2002

(65) Prior Publication Data

US 2002/0185957 A1 Dec. 12, 2002

Related U.S. Application Data

(63) Continuation of application No. 09/645,606, filed on Aug. 25, 2000, now Pat. No. 6,445,116, which is a continuation of application No. 09/145,884, filed on Sep. 2, 1998, now Pat. No. 6,111,350.

(30) Foreign Application Priority Data

Sep. 5, 1997 (JP) ..... 9-241290

(51) Int. Cl.[7] ..... H01J 29/50
(52) U.S. Cl. ..... 313/449; 313/414; 313/412
(58) Field of Search ..... 313/414, 412, 313/448, 449, 441, 447, 415, 452; 315/382

(56) References Cited

U.S. PATENT DOCUMENTS

| | | | | |
|---|---|---|---|---|
| 5,909,080 A | | 6/1999 | Uchida et al. | |
| 5,942,844 A | | 8/1999 | Nakamura et al. | |
| 6,031,346 A | | 2/2000 | Shirai et al. | |
| 6,111,350 A | * | 8/2000 | Uchida et al. | 313/414 |
| 6,445,116 B1 | * | 9/2002 | Uchida et al. | 313/414 |

FOREIGN PATENT DOCUMENTS

| | | |
|---|---|---|
| JP | 63-86224 | 4/1988 |
| JP | 63-12147 | 5/1988 |
| JP | 5-225930 | 9/1993 |
| JP | 6-223739 | 8/1994 |
| JP | 6-236737 | 8/1994 |
| JP | 6-283112 | 10/1994 |
| JP | 7-29509 | 1/1995 |
| JP | 7-50138 | 2/1995 |
| JP | 7-296740 | 11/1995 |
| JP | 8-329854 | 12/1996 |
| JP | 9-171780 | 6/1997 |
| JP | 9-171781 | 6/1997 |
| JP | 9-190774 | 7/1997 |
| JP | 9-199051 | 7/1997 |

* cited by examiner

*Primary Examiner*—Nimeshkumar D. Patel
*Assistant Examiner*—Karabi Guharay
(74) *Attorney, Agent, or Firm*—Antonelli, Terry, Stout & Kraus, LLP

(57) ABSTRACT

Each of an anode and one of the sub-electrodes of a main lens of a shadow mask color cathode ray tube includes a first member having a single opening in their facing ends, and a second member having three beam apertures, wherein $$(A+566)/106>H-2\times S$$

is satisfied, where A is V1×V2×T, V1 is a vertical diameter of the opening, V2 is a vertical diameter of the center beam aperture, T is a distance between the opening and the second electrode member, H is a horizontal diameter of the opening, S is P×L/Q, where P is a horizontal center-to-center spacing between adjacent phosphor elements, Q is a spacing between the phosphor screen and the shadow mask, and L is a distance between the shadow mask and the opening in the first member.

7 Claims, 6 Drawing Sheets

COLOR CATHODE RAY TUBE HAVING AN IMPROVED ELECTRON GUN

CROSS REFERENCE TO RELATED APPLICATION

This is a continuation of U.S. application Ser. No. 09/645,606, filed Aug. 25, 2000, now U.S. Pat. No. 6,445,116, which is a continuation of U.S. application Ser. No. 09/145,884, filed Sep. 2, 1998, now U.S. Pat. No. 6,111,350, the subject matter of which is incorporated by reference herein.

BACKGROUND OF THE INVENTION

The present invention relates to a color cathode ray tube and particularly to a shadow mask type color cathode ray tube having an improved resolution capability. Color cathode ray tube such as color picture tubes and display tubes have been widely used as receivers of TV broadcasting or monitors in information processing equipment because of their high-resolution capability.

Generally, such color cathode ray tubes comprise a phosphor screen formed on an inner surface of a faceplate of a panel portion of an evacuated envelope, a shadow mask having a multiplicity of electron beam apertures and spaced from the phosphor screen within the panel portion, an electron gun of the in-line type for projecting electron beams toward the phosphor screen and housed in a neck portion of the evacuated envelope, and a deflection yoke mounted around a funnel portion of the evacuated envelope.

FIG. 6 is a schematic cross sectional view for explaining a construction of a shadow mask type color cathode ray tube as an example of a color cathode ray tube to which the present invention is applicable. In FIG. 6, reference numeral 20 is a faceplate, 21 is a neck, 22 is a funnel for connecting the faceplate 20 and the neck 21, 23 is a phosphor screen serving as an image display screen formed on an inner surface of the faceplate 20, 24 is a shadow mask serving as a color selection electrode, 25 is a mask frame for supporting the shadow mask 24 and for forming a shadow mask assembly, 26 is an inner shield for shielding extraneous ambient magnetic fields, 27 is a suspension spring mechanism for suspending the shadow mask assembly on studs embedded in the inner sidewall of the faceplate 20, 28 is an electron gun housed in the neck 21 for projecting three electron beams Bs (X2) and Bc, 29 is a deflection device for deflecting the electron beams horizontally and vertically, 30 is a magnetic device for adjusting color purity and centering the electron beams, 31 is a getter, 32 is an internal conductive coating, 33 is an implosion protection band, and 34 are stem pins for supplying voltages on the electron gun 28.

The evacuated envelope is formed of a faceplate 20, a neck 21 and a funnel 22. The magnetic deflection fields generated by the deflection device 29 deflect the three in-line electron beams emitted from the electron gun 28 horizontally and vertically to scan the phosphor screen 23 in two dimensions. The three electron beams Bc, Bs X2 are modulated by the green signal (center beam Bc), the blue signal (side beam Bs) and the blue signal (side beam Bs), respectively, and after being subjected to color selection by beam apertures in the shadow mask 24 disposed immediately in front of the phosphor screen 23, impinge on respective phosphor elements of red, green and blue colors of the tricolor mosaic phosphor screen 23 to reproduce the intended color image.

FIGS. 7A to 7C are illustrations of a construction example of the in-line type electron gun applicable to the color cathode ray tube shown in FIG. 6, FIG. 7A is a horizontal sectional view thereof, and FIG. 7B is a schematic sectional view of the major portion of FIG. 7A, taken along the VIIB—VIIB, and FIG. 7C is a schematic sectional view of the major portion of FIG. 7A, taken along the VIIC—VIIC. In FIG. 7A, reference numerals Ia to Ic are cathode structures, 2 is a control grid electrode, 3 is an accelerating electrode, 4 is a focus electrode, 5 is an anode, 6 is a shield cup, 41 is a first focus sub-electrode, 42 is a second focus sub-electrode, and the first and second sub-electrodes 41, 42 form a focus electrode 4. Vertical plates 411 are attached to the first focus sub-electrode 41 on the second focus sub-electrode 42 side thereof such that they sandwich each of three electron beams horizontally and they extend toward the second focus sub-electrode 42, a pair of horizontal plates 421 are attached to the second focus sub-electrode 42 on the first focus sub-electrode 41 side thereof such that they sandwich three electron beams vertically and they extend toward the first focus sub-electrode 41, and the vertical plates 411 and the horizontal plates 421 form a so-called electrostatic quadrupole lens. The correction plate electrode 422 with a beam aperture for each of the three electron beams is disposed within the second focus sub-electrode 42 and the correction plate electrode 51 with a beam aperture for each of the three electron beams is disposed within the anode 5.

The vertical plates 411 and the horizontal plates 421 of the electrostatic quadrupole lens, as respectively shown in FIGS. 7B and 7C, are such that the vertical plates 411 are comprised of four plates 411*a*, 411*b*, 411*c* and 411*d* arranged in such a manner as to sandwich side beam apertures 41*s* and a center beam aperture 41*c* in the first focus sub-electrode 41 individually and horizontally and the horizontal plates 421 are comprised of a pair of plates 421*a* and 421*b* arranged in such a manner as to sandwich side beam apertures 42*s* and a center beam aperture 42*c* in the second focus sub-electrode 42 in common and vertically.

The cathode structures 1*a* to 1*c*, the control grid electrode 2 and the accelerating electrode 3 form an electron beam generating section. Thermoelectrons emitted from the heated cathode structure 1 are accelerated toward the control grid electrode 2 by an electric potential of the accelerating grid electrode 3 and form three electron beams. The three electron beam pass through the apertures in the control grid electrode 2, and the apertures in the accelerating electrode 3, and after having astigmatism corrected by the electrostatic quadrupole lens disposed between the first and second focus sub-electrodes 41 and 42, and enter the main lens formed between the second focus sub-electrode 42 and the anode 5. The three electron beams are focused by the main lens, and after being subjected to color selection by the shadow mask, and impinge upon the intended respective phosphor elements of the phosphor screen and produce the bright spots of the intended colors.

The first focus sub-electrode 41 is supplied with a fixed voltage Vf1 and the second focus sub-electrode 42 is supplied with a dynamic voltage Vf2+dVf which is a fixed voltage Vf2 superposed with a voltage dVf varying in synchronism with deflection angles of the electron beams. The anode 5 is supplied with the highest voltage Eb via the internal conductive coating 32 (see FIG. 6) coated on the inner surface of the funnel 22.

With this construction, the curvature of the image field is corrected by varying the lens strength with the deflection angle of the electron beams and astigmatism is corrected by the electrostatic quadrupole lens such that the focus length of the electron beams and the shape of the beam spots are controlled to provide good focus over the entire phosphor screen.

To obtain a normal round beam spot at the center of the phosphor screen, the horizontal and vertical effective lens diameters are approximately equalized with each other for each of the three electron beams by optimization in terms of the dimensions of the single openings common for the three electron beams in the second focus sub-electrode 42 and the anode 5 for forming the main lens portion, the dimensions of the beam apertures in the correction plate electrodes 422, 51 disposed within the second focus sub-electrode 42 and the anode 5, and the axial distances between the correction plate electrodes 422, 51 and the single openings in the second focus sub-electrode 42 and the anode 5 incorporating the correction plate electrodes 422, 51.

With such a lens, the resolution capability of the electron beams scanning the phosphor screen was improved and reproduced the high quality image.

The prior art as described above is disclosed in Japanese Patent Application Laid-open Publication No. Hei 2-189842, for example.

SUMMARY OF THE INVENTION

Focus characteristics of cathode ray tubes are greatly influenced by the width of horizontal scan lines. In the prior art electron guns, the horizontal and vertical effective lens diameters of the main lens are equalized with each other and the problem arises in that the maximum lens diameter of the main lens is limited by the smaller one of the maximum allowable horizontal and vertical lens diameters of the main lens which are limited by the horizontal or vertical dimension of the structure of the electron gun housed in the neck portion of the cathode ray tube.

Generally, the lens dimension is limited more rigidly in the horizontal direction in which the three in-line electron beams are arranged, and the vertical lens dimension is made so smaller as to be equal to the horizontal lens dimensional though the vertical lens dimension can be increased. Therefore the vertical diameter of an electron beam spot on the phosphor screen cannot be decreased compared with its horizontal diameter and this causes a problem in that it is difficult to reduce the width of the horizontal scan lines.

Also there is a problem in that, if eccentricity of the electrodes is caused in the manufacturing process such as the assembling of the electron gun and the electron beams do not pass through the center of the main lens, the vertical diameter of the beam spot at the phosphor screen increases as much due to vertical eccentricity as its horizontal diameter increases due to horizontal eccentricity, although the increase in the vertical diameter of the beam spot due to the vertical eccentricity can be suppressed to a smaller value.

An object of the present invention is to solve the above-mentioned problems of the prior art and to provide a color cathode ray tube capable of a high resolution image display by reducing the vertical diameter of the electron beam spots on the phosphor screen.

To accomplish the above object, in accordance with the present invention, there is provided a color cathode ray tube comprising an evacuated envelope comprising a panel portion, a neck portion and a funnel portion for connecting the panel portion and the neck portion, a three-color phosphor screen formed on an inner surface of the panel portion, a shadow mask having a multiplicity of apertures therein and spaced from the phosphor screen, a three-beam in-line type electron gun housed in the neck portion, the three-beam in-line type electron gun including an electron beam generating section for generating three electron beams and a main lens section for focusing the three electron beams on the three-color phosphor screen, and a deflecting device mounted in a vicinity of a transition region between the funnel portion and the neck portion for scanning the three electron beams on the three-color phosphor screen, wherein the main lens section comprises a focus electrode and an anode facing the focus electrode, the focus electrode being composed of plural focus sub-electrodes, each of the anode and a first one of the focus sub-electrodes facing the anode comprises a first electrode member having a single opening common for the three electron beams in an end thereof facing another of the anode and the first one of the focus sub-electrodes, and a second electrode member set back from the end of the first electrode member for forming three beam apertures for passing the three electron beams, respectively, and a following inequality is satisfied:

$$(A+566)/106>H-2\times S,$$

where A is $V1\times V2\times T$, V1 is a vertical diameter of the single opening, V2 is a vertical diameter of a center one of the three beam apertures and T is an axial distance between the single opening and the second electrode member, H is a horizontal diameter of the single opening, and S is $P\times L/Q$, where P is a horizontal center-to-center spacing between adjacent phosphor elements at a center of the three-color phosphor screen, Q is an axial spacing between the three-color phosphor screen and the shadow mask at the center of the three-color phosphor screen, and L is an axial distance between the shadow mask and the single opening in the first electrode member of the first one of the focus sub-electrodes.

In accordance with an embodiment of the present invention, there is provided a color cathode ray tube comprising an evacuated envelope comprising a panel portion, a neck portion and a funnel portion for connecting the panel portion and the neck portion, a three-color phosphor screen formed on an inner surface of the panel portion, a shadow mask having a multiplicity of apertures therein and spaced from the phosphor screen, a three-beam in-line type electron gun housed in the neck portion, the three-beam in-line type electron gun including an electron beam generating section for generating three electron beams arid a main lens Section for focusing the three electron beams on the three-color phosphor screen, and a deflecting device mounted in a vicinity of a transition region between the funnel portion and the neck portion for scanning the three electron beams on the three-color phosphor screen, wherein the main lens section comprises a focus electrode and an anode facing the focus electrode, the focus electrode being composed of plural focus sub-electrodes, each of the anode and a first one of the focus sub-electrodes facing the anode comprises a first electrode member having a single opening common for the three electron beams in an end thereof facing another of the anode and the first one of the focus sub-.electrodes, and a second electrode member set back from the end of the first electrode member for forming three beam apertures for passing the three electron beams, respectively, the focus sub-electrodes include at least one sub-electrode of a first group adapted to be supplied with a first focus voltage and at least one sub-electrode of a second group adapted to be supplied with a second focus voltage, the second focus voltage being a fixed voltage superposed with a dynamic voltage varying with deflection of the three electron beams, an electrostatic quadrupole lens is formed between facing ends of one of the at least one sub-electrode of the first group and one of the at least one sub-electrode of the second group facing the one of the at least one sub-electrode of the first group, and a following inequality is satisfied:

$$V1>H-2\times S,$$

where V1 is a vertical diameter of the single opening, H is a horizontal diameter of the single opening, and S is P×L/Q, where P is a horizontal center-to-center spacing between adjacent phosphor elements at a center of the three-color phosphor screen, Q is an axial spacing between the three-color phosphor screen and the shadow mask at the center of the three-color phosphor screen, and L is an axial distance between the shadow mask and the single opening in the first electrode member of the first one of the focus sub-electrodes.

BRIEF DESCRIPTION OF THE DRAWINGS

In the accompanying drawings, in which like reference numerals designate similar components throughout the figures, and in which:

FIG. 7A is a horizontal sectional view thereof, and FIG. 7B is a schematic sectional view of the major portion of FIG. 7A, taken along the VIIB—VIIB, and FIG. 7C is a schematic sectional view of the major portion of FIG. 7A, taken along the VIIC—VIIC.

DETAILED DESCRIPTION OF THE PREFERRED EMBODIMENTS

The embodiments of the present invention will be explained in detail hereunder with reference to the accompanying drawings.

Figure 1:
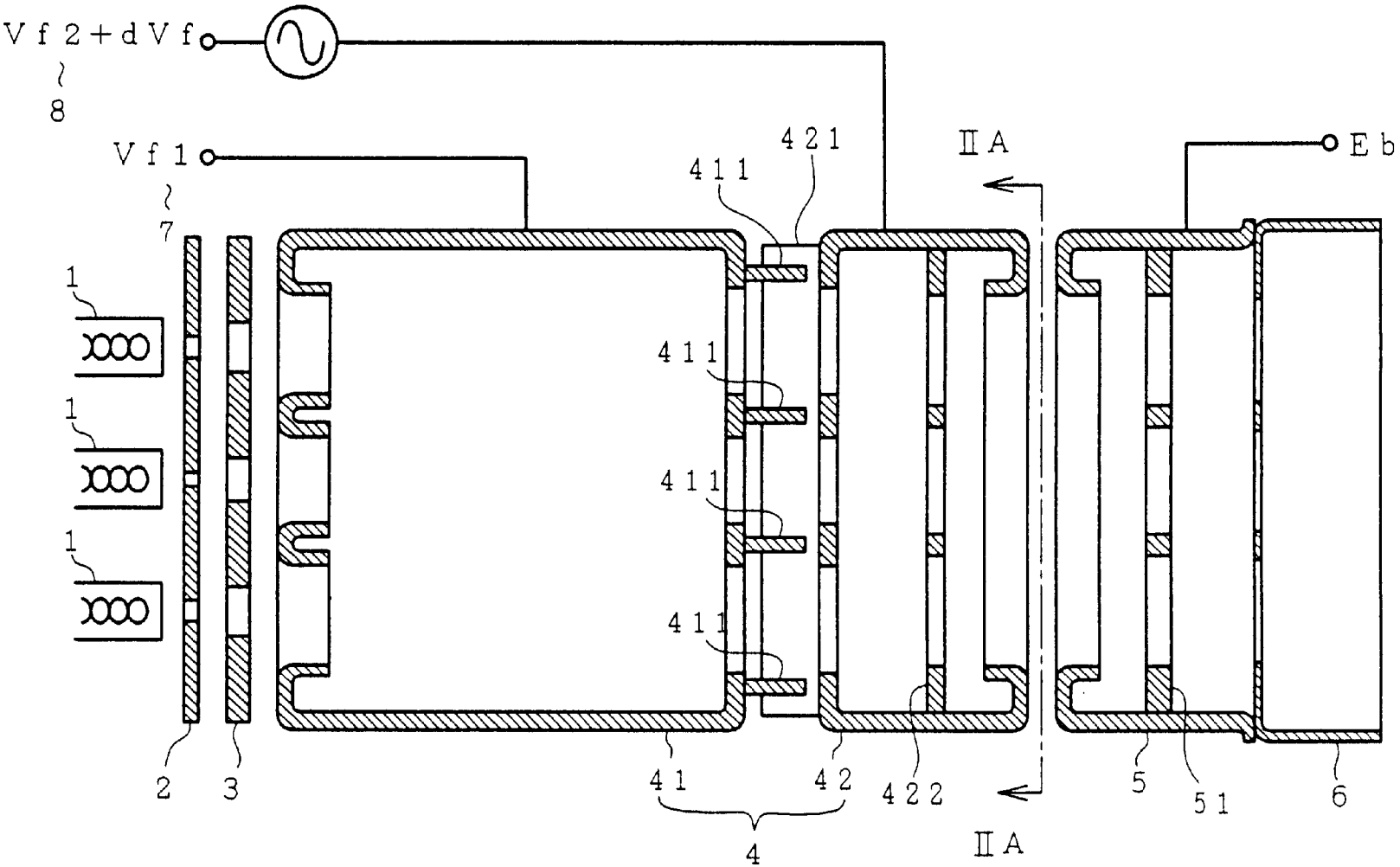
FIG. 1 is a horizontal cross sectional view of an electron gun used in a first embodiment of a color cathode ray tube of the present invention.
Figure 2A:
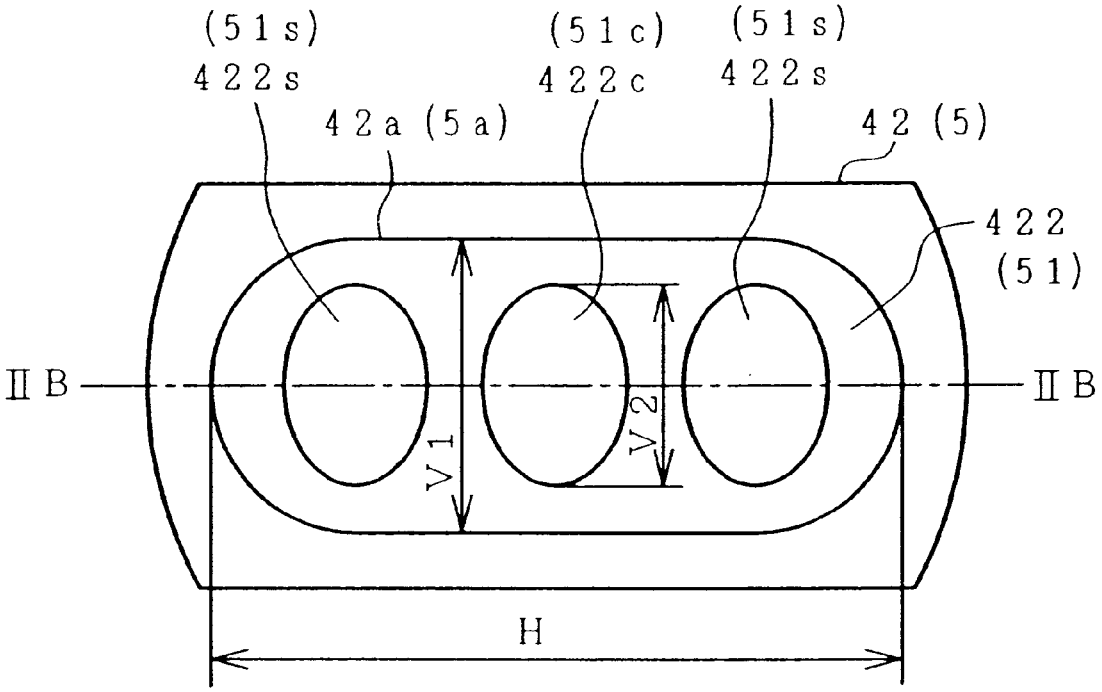
FIGS. 2A and 2B are enlarged view of electrodes which can be used as a second focus sub-electrode and an anode in the electron gun of FIG. 1, FIG. 2A being a front view of the second focus sub-electrode 42 viewed along the line IIA—IIA of FIG. 1 in the direction of the arrows, and FIG. 2B being a cross sectional view of the second focus sub-electrode 42 viewed along the line IIB—IIB of FIG. 2A.
Figure 2B:
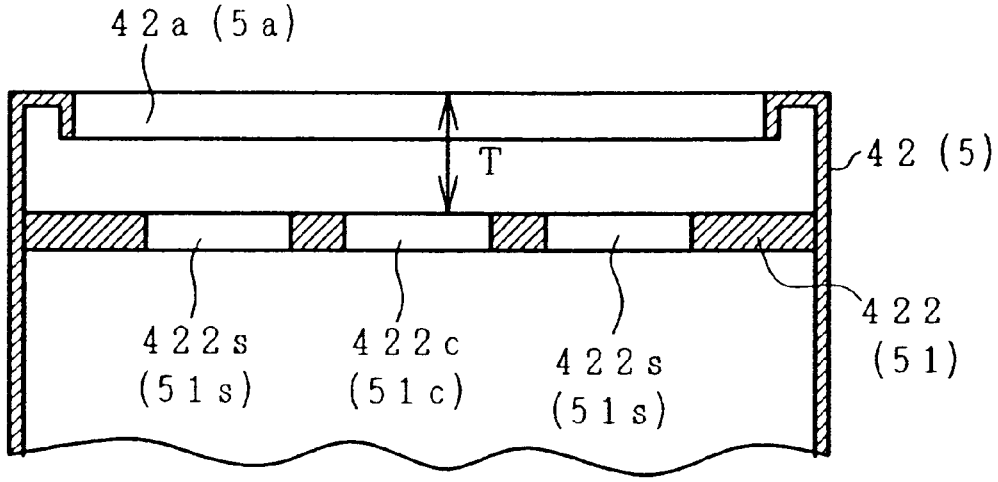

FIG. 1 is a horizontal cross sectional view of an electron gun used in an embodiment of a color cathode ray tube of the present invention. FIGS. 2A and 2B are enlarged view of electrodes which can be used as a second focus sub-electrode and an anode in the electron gun of FIG. 1, FIG. 2A being a front view of the second focus sub-electrode 42 viewed along the line IIA—IIA of FIG. 1 in the direction of the arrows, and FIG. 2B being a cross sectional view of the second focus sub-electrode 42 viewed along the line IIB—IIB of FIG. 2A.

The following explain the case in which the electrodes of FIGS. 2A and 2B are used for the second focus sub-electrode 42. The following explanation applies to the anode 5 as well as to the second sub-electrode 42, and reference numerals in the parentheses refer to corresponding parts of or associated with the anode 5.

FIGS. 2A and 2B define the vertical diameter V1 (mm) of the single openings 42*a*, 5*a* common for the three electron beams, the vertical diameter V2 (mm) of the beam apertures 422*c*, 422*s*, 51*c*, 51*s*, in the plate electrodes 422, 51 disposed within the electrodes 42, 5 having the single openings 42*a*, 5*a*, and the axial distances T between the plate electrodes 422, 51 and the single openings 42*a*, 5*a* in the electrodes 42, 5 incorporating the plate electrodes 422, 51.

The effective vertical lens diameter of the main lens is determined by the vertical diameter V1 (mm) of the single openings 42*a*, 5*a* common for the three electron beams, the vertical diameter V2 (mm) of the beam apertures 422*c*, 422*s*, 51*c*, 51*s* in the plate electrodes 422, 51 disposed within the electrodes 42, 5 having the single openings 42*a*, 5*a*, and the axial distance T (mm) between the plate electrodes 422, 51 and the single openings 42*a*, 5*a* in the electrodes 42, 5 incorporating the plate electrodes 422, 51. The product A is defined as the product V1×V2×T.

The amount of penetration of electric fields into the electrode is approximately proportionate to each of V1, V2 and T, and the vertical lens diameter Dv (mm) increases with an increasing amount of the penetration. The lens diameter Dv increases approximately linearly with the product A. The inventors have found the following relationship by analyzing various lens structures.

$$A=106Dv-566 \quad (1)$$

In the electron gun of the color cathode ray tube of the present invention, a distance Dh/2 between the center of the path of the undeflected side electron beam and the closest vertical edge of the single opening is the minimum distance between the center of the path of the undeflected side electron beam and the edge of the single opening and is the minimum effective horizontal radius of the main lens.

Generally, in the main lens of the electron gun, the position of the plate electrodes and the shape of the elliptical apertures in the plate electrodes are adjusted to equalize the horizontal and vertical lens radii for the center electron beam with those for the side electron beams. If a difference in the effective main lens diameters between the center electron beam and the side electron beams is present, the difference in the optimum focusing conditions at the phosphor screen is produced between the center and side electron beams, increases the beam spot diameter of one of the center and side electron beams and degrades resolution.

With the structure of the electron gun in the color cathode ray tube of the present invention, the effective horizontal diameters of the main lens are approximately the above-described Dh for both the center and side beams. The horizontal diameter Dh of the main lens is represented by the horizontal diameter H of the single opening and the beam spacing S between the center and side electron beams in the main lens as follows:

$$Dh=H-(2\times S) \quad (2)$$

In ordinary shadow mask type color cathode ray tubes, as described subsequently with reference to FIG. 3, the beam spacing S between the center and side electron beams in the main lens is represented by the horizontal center-to-center spacing P between adjacent phosphor dots or phosphor lines at the center of the phosphor screen, the axial spacing Q between the inner surface of the panel portion and the shadow mask at the center of the panel portion, and the axial distance L between the shadow mask and the single opening common for three electron beams formed in the focus electrode as follows:

$$S=P\times L/Q$$

where reference character ML indicates the position of the main lens.

This is because the center and side electron beams are spaced a distance S from each other when they pass through the main lens, pass through the same aperture in the shadow mask and impinge upon the respective phosphor elements of the corresponding colors coated on the inner surface of the panel portion. The above equation is obtained because the triangle FGU is similar to the triangle RTU in FIG. 3 and the relationship of $S/P\approx L/Q$ exists.

To accomplish the object of the present invention which is to make the vertical diameter Dv of the main lens larger than its horizontal diameter Dh, it is necessary that the following inequality is satisfied:

$$Dv>Dh \quad (3)$$

The substitution of Dv from the equation (1) and Dh from the equation (2) into the inequality (3) gives the following:

$$(A+566)/106>H-(2\times S) \quad (4)$$

The structure of the electron gun designed to satisfy the inequality (4) can reduce the vertical diameter of the beam spot on the phosphor screen and improve the resolution.

Next, the specific embodiments of the present invention will be explained in detail hereunder with reference to the accompanying drawings.

FIG. 1 is a horizontal cross sectional view of an electron gun used in a first embodiment of a color cathode ray tube of the present invention. Reference numeral 1 is a cathode structure, 2 is a control grid electrode, 3 is an accelerating electrode, 4 is a focus electrode, 5 is an anode, and 6 is a shield cup. Reference numeral 41 is a first focus sub-electrode, 42 is a second focus sub-electrode, these two electrodes form a focus electrode. Reference numerals 411 and 421 are plate electrode segments for forming the electrostatic quadrupole lens, and 422 and 51 are plate electrodes having three beam apertures therein disposed in the second focus sub-electrode 42 and the anode 5, respectively.

Thermoelectrons emitted from the heated cathode structure 1 are accelerated toward the control grid electrode 2 by an electric potential applied to the accelerating electrode 3 and form three electron beams. These three electron beams pass through the respective apertures in the control grid electrode 2 and then through the respective apertures in the accelerating electrode 3, are slightly focused by a prefocus lens formed between the accelerating electrode 3 and the first focus sub-electrode 41 before they enter the main lens formed between the second focus sub-electrode 42 and the anode 5, and enter the main lens accelerated by an electric potential of the first focus sub-electrode 41. Then the electron beams are focused by the main lens onto the phosphor screen to produce beam spots on the screen.

The plate electrodes 422 and 51, respectively, disposed in the second focus sub-electrode 42 and the anode 5 control the shape and focus of the beam spots on the phosphor screen by adjusting the size and shape of the beam apertures 422*c*, 422*s*, 51*c*, 51*s* in the plate electrodes 422 and 51, and the amount of the setback of the plate electrodes 422 and 51 from the single opening in the second focus sub-electrode 42 and the anode 5 into the second focus sub-electrode 42 and the anode 5, respectively, as described later.

The first focus sub-electrode 41 is supplied with a fixed voltage (Vf1) 7 and the second focus sub-electrode 42 is supplied with a dynamic voltage (Vf2+dVf) 8 varying in synchronism with deflection angles of the electron beams scanning the phosphor screen. Reference character Eb denotes the anode voltage.

With this constitution, the curvature of the image field is corrected by varying the strength of the main lens with the deflection angle of the electron beams and astigmatism is corrected by the electrostatic quadrupole lens formed by the vertical electrode segments 411 and the horizontal electrode segments 421 respectively attached to the first focus sub-electrode 41 and the second focus sub-electrode 42 so that the focus length of the lens and the shape of the beam spot are controlled to produce finely focused beam spots over the entire phosphor screen.

FIGS. 2A and 2B are enlarged view of electrodes which can be used as a second focus sub-electrode 42 and an anode 5 in the electron gun of FIG. 1. The following explain the case in which the electrodes of FIGS. 2A and 2B are used for the second focus sub-electrode 42. The following explanation applies to the anode 5 as well as to the second sub-electrode 42, and reference numerals in the parentheses refer to corresponding parts of or associated with the anode 5. FIG. 2A is a front view of the second focus sub-electrode 42 viewed along the line IIA—IIA of FIG. 1 in the direction of the arrows. FIG. 2B is a cross sectional view of the second focus sub-electrode 42 electrode 42 taken along the line IIB—IIB of FIG. 2A.

In FIGS. 2A and 2B, V1 and H are respectively vertical and horizontal diameters of a single opening 42*a* common for three electron beams and formed in the second focus sub-electrode 42 for forming the main lens. V2 is a vertical diameter of the center beam aperture 422*c* in the plate electrode 422 having three beam apertures 422*s* and 422*c* and disposed in the second focus sub-electrode 42 and T is an axial distance between the single opening 42*a* and the plate electrode 422.

As explained above, the first focus sub-electrode 41 is supplied with a first focus voltage of a fixed value and the second focus sub-electrode 42 is supplied with a second focus voltage which is a fixed voltage superposed with a dynamic voltage varying in synchronism with the deflection angle of the electron beams.

When V1 is 10 mm, V2 is 10 mm and T is 5 mm, the product A which is $$V1\times V2\times T \text{ is } 10\times 10\times 5=500.$$

Figure 3:
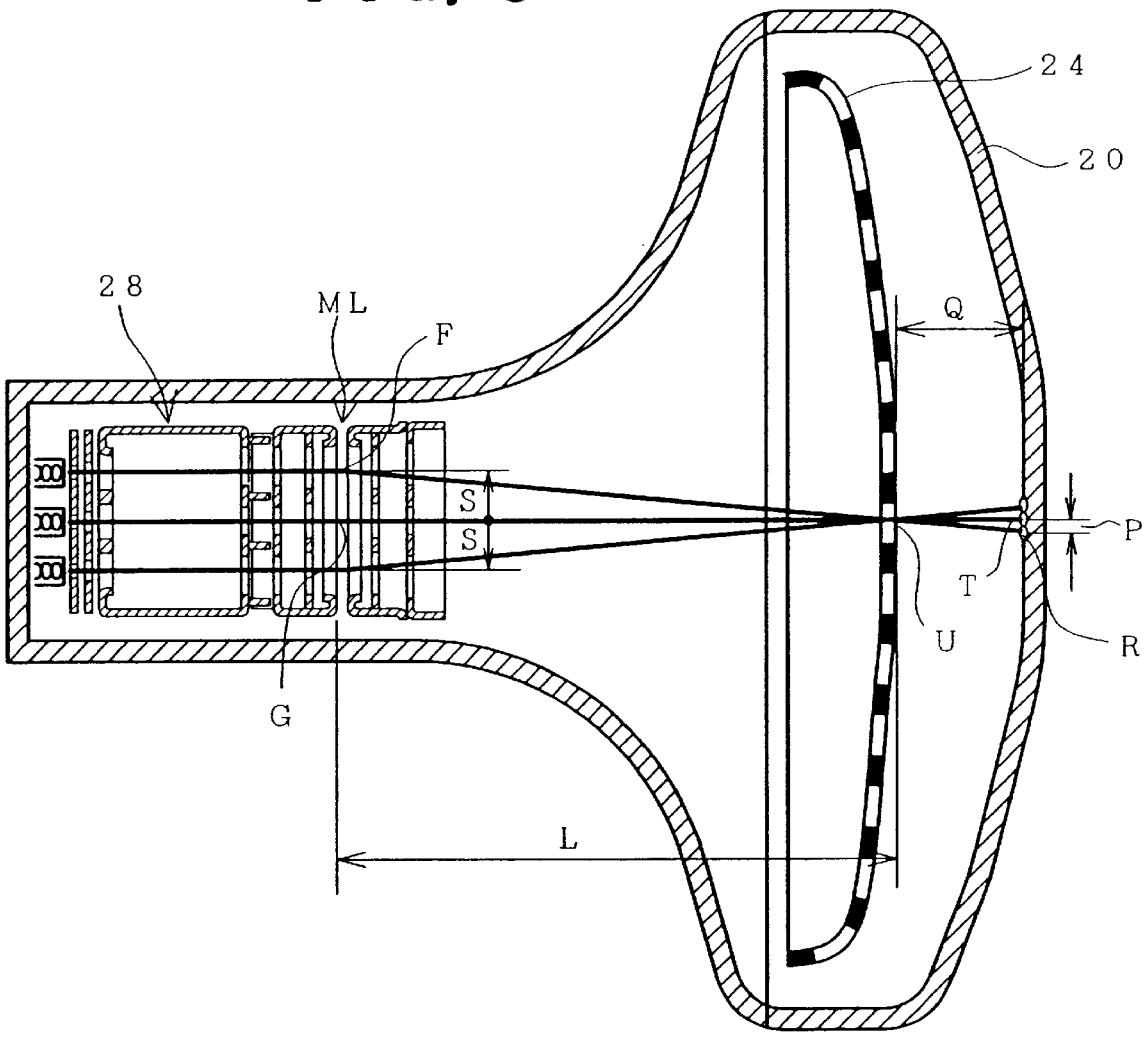
FIG. 3 is a schematic horizontal cross sectional view of a color cathode ray tube of the present invention.
Figure 6:
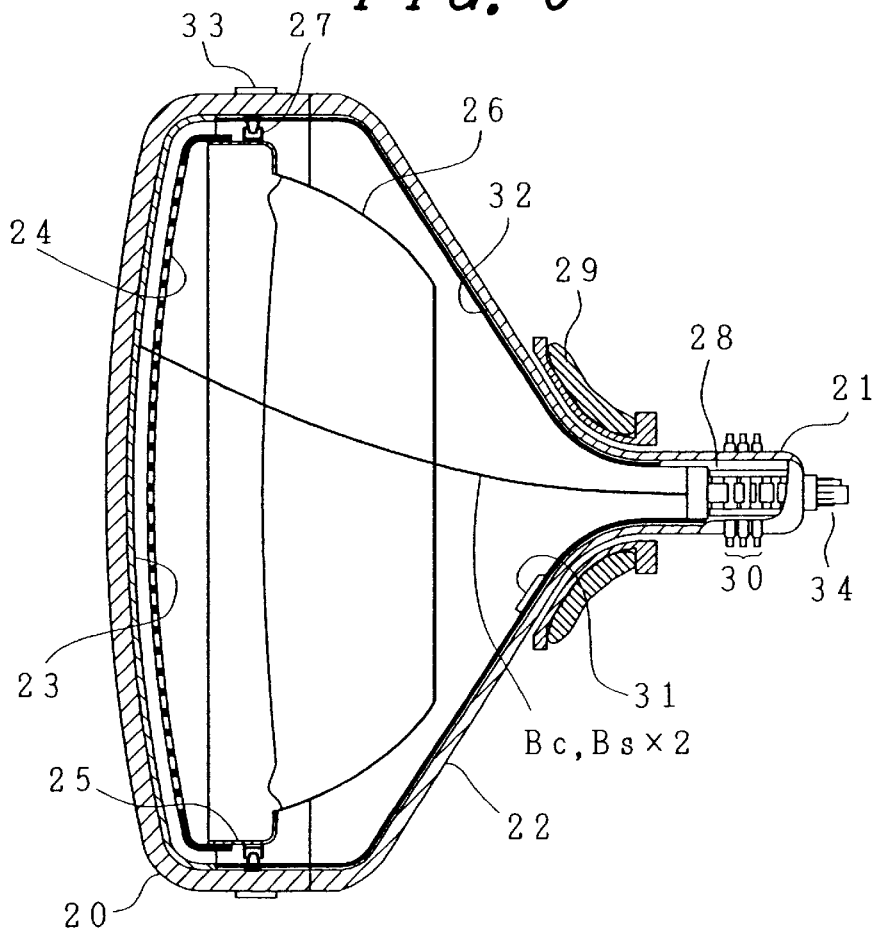
FIG. 6 is a schematic cross sectional view of a shadow mask type color cathode ray tube as an example of the color cathode ray tube to which the present invention is applicable.
Figure 7A:
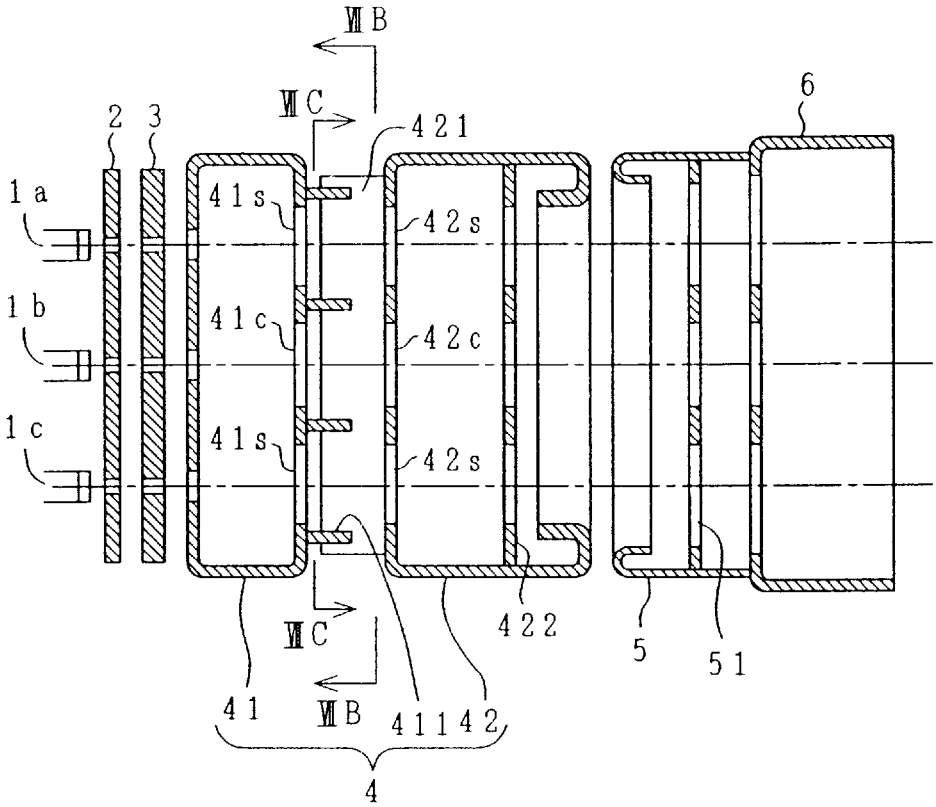
FIG. 7A (PRIOR ART)
FIGS. 7A to 7C are illustrations of a construction example of the in-line type electron gun applicable to the color cathode ray tube shown in FIG. 6.
Figure 7B:
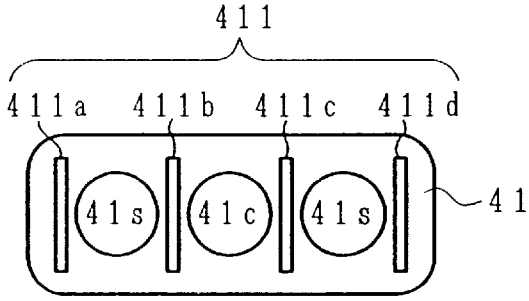
FIG. 7B (PRIOR ART)
Figure 7C:
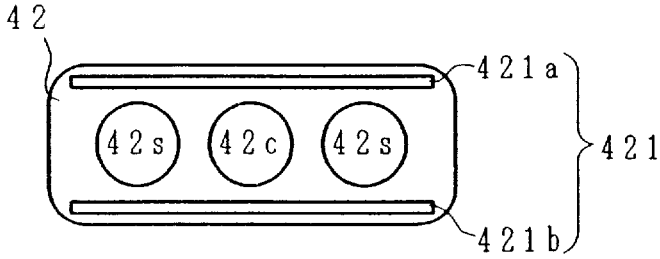
FIG. 7C (PRIOR ART)

FIG. 3 is a schematic horizontal cross sectional view of a color cathode ray tube of the present invention, and reference character ML denotes the position of the main lens. The same reference numerals as utilized in FIG. 6 designate corresponding portions in FIG. 3. In FIG. 3, suppose the horizontal center-to-center spacing P between adjacent phosphor dots or phosphor lines at the center of the phosphor screen is 0.15 mm, the axial spacing Q between the inner surface (phosphor screen) of the panel portion 20 and the shadow mask 24 at the center of the panel portion is 10.5 mm, and the axial distance L between the shadow mask 24 and the position ML of the main lens is 360 mm. The above-described beam spacing S becomes $$0.15\times360/10.5=5.14.$$

In FIG. 2A, suppose the horizontal diameter H of the single opening 42*a* formed in the second focus sub-electrode 42 on the anode 5 side thereof for forming the main lens is 19 mm. Substitution of these values into the inequality (4) gives 10.6>8.72.

This indicates the inequality (4) is satisfied and the vertical diameter of the electron beam spot can be reduced on the phosphor screen.

In this embodiment, the electron gun satisfying the inequality (4) includes the electrostatic quadrupole lens the lens strength of which varies with a focus voltage varying with the deflection angle of the electron beams and supplied to the second focus sub-electrode 42. This construction enables correction for a difference in focusing conditions of the electron beams between the horizontal and vertical directions, and focusing of the electron beams is easily optimized in the horizontal and vertical diameters of the electron beam spots, and the resolution can be effectively improved even though the horizontal and vertical diameters of the main lens differ from each other.

The above explanation is given in connection with the center beam aperture 422*c* in the plate electrode 422 because the center electron beam is usually used to display green signals, green color provides a larger contribution to the brightness of white than red and blue colors for displaying a white scene, and consequently the green electron gun is required to provide a high resolution image. Therefore it is essential for the main lens for the center electron beam to satisfy the inequality (4), and when the high resolution display. By the side electron beams are required, it is preferable for the side beam apertures 422*s* in the plate electrode 422 and the structure associated with it to satisfy the inequality (4).

In the above embodiment, the single opening 42*a* in the second focus sub-electrode 42, the beam aperture 422*c* in the plate electrode 422, and the setback distance T in the first focus sub-electrode 42 are identical to the single opening 5*a*, the plate electrode 51, the beam aperture 51*c*, and the setback distance T in the anode 5, respectively, but it is not always necessary, it is sufficient that each of the anode electrode geometry and the focus electrode geometry satisfies the inequality (4) independently to provide the advantages in the above embodiment even if they are different in electrode geometry.

Next, a second embodiment of the present invention will be explained.

Figure 4:
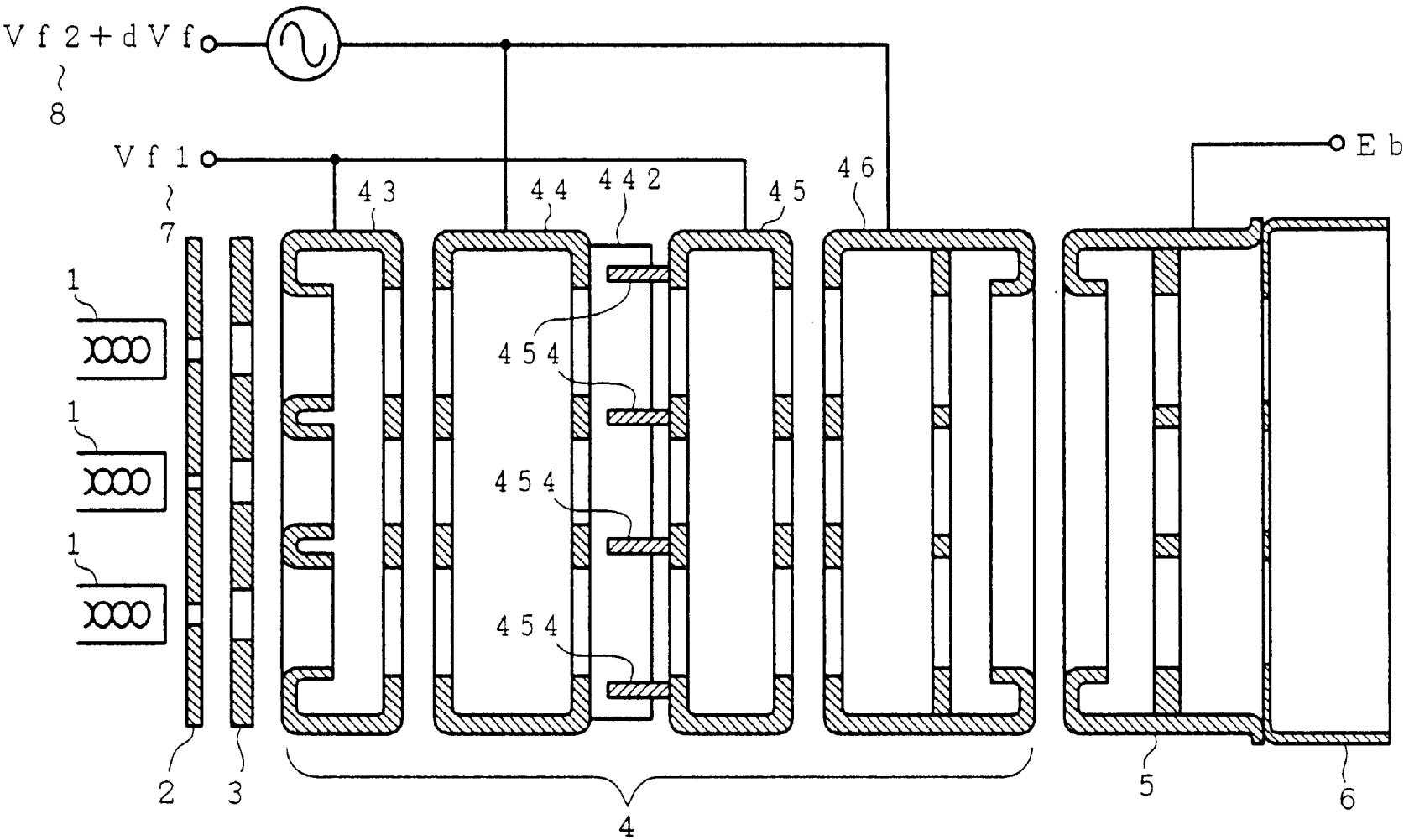
FIG. 4 is a horizontal cross sectional view of an electron gun used in a second embodiment of the color cathode ray tube of the present invention.

FIG. 4 is a horizontal cross sectional view of an electron gun used in a second embodiment of the color cathode ray tube of the present invention. The same reference numerals as utilized in FIG. 1 designate corresponding portions in FIG. 4. The focus electrode 4 is comprised of first, second, third and fourth sub-electrodes 43, 44, 45, 46.

The first group of focus sub-electrodes is comprised of the first focus sub-electrode 43 and the third focus sub-electrode 45 both of which are supplied with a first focus voltage Vf1, 7 of a fixed value. The second group of focus sub-electrodes is comprised of the second focus sub-electrode 44 and the fourth focus sub-electrode 46 both of which are supplied with a second focus voltage Vf2+dVf, 8 which is a fixed voltage Vf2 superposed with a voltage dVf varying in synchronism with the deflection angle of the electron beams.

The electrostatic quadrupole lens is formed between the second focus sub-electrode 44 and the third focus sub-electrode 45 and functions as in the previous embodiment. The electrostatic quadrupole lens is comprised of horizontal plates 442 and vertical plates 454 attached to the second focus sub-electrode 44 and the third focus sub-electrode 45, respectively.

In this embodiment, the electrostatic quadrupole lens is formed between the second focus sub-electrode 44 and the third focus sub-electrode 45, but the present invention is not limited to this arrangement, the electrostatic quadrupole lens can be formed between the first focus sub-electrode 43 and the second focus sub-electrode 44,
or between the third focus sub-electrode 45 and the fourth focus sub-electrode 46, for example.

The order of the arrangement of the vertical and horizontal plates of the electrostatic quadrupole lens is not limited to the order shown in FIG. 4, the vertical plates can be attached to one on the cathode side of the two opposing electrodes and the horizontal plates can be attached to the other on the phosphor screen side of the two opposing electrodes.

The focus electrode 4 comprised of the first, second, third and fourth focus sub-electrodes 43, 44, 45 and 46 is configured such that a curvature of the image field correction lens is formed to vary the lens strength for focusing the three electron beams in both the horizontal and vertical directions with the magnitude of the applied voltage, and the electrostatic quadrupole lens is formed to vary the lens strength for focusing the three electron beams in one of the horizontal and vertical directions and diverging them in the other of the two directions with the magnitude of the applied voltage.

When the fourth focus sub-electrode 46 and the anode 5 for forming the main lens adopt the same dimensions as in the previous embodiment in which the horizontal and vertical diameters of the main lens differ from each other, focusing of the electron beams is easily optimized in the horizontal and vertical diameters of the electron beam spots and the resolution can be effectively improved.

The electron gun of this structure includes, within the focus electrode, the lens for correcting the curvature of the image field which weakens its lens strength with beam deflection angle so as to control its focus length and provides the best focused beam spot shape even at the periphery of the phosphor screen, for the purpose of lowering the dynamic focus voltage by improving the sensitivity of correction of the curvature of the image field compared with the electron gun of the first embodiment shown in FIG. 1, as disclosed in Japanese Patent Application Laid-Open Publication No. Hei 4-43532, for example. When the electron gun of this structure is as indicated in FIG. 4, the electrode voltages are such that the first focus voltage Vf1 of a fixed value applied to the first group of focus sub-electrodes is made higher than the second focus voltage Vf2 of a fixed value applied to the second group of focus sub-electrodes and the dynamic voltage dVf superposed on the fixed voltage Vf2 increases with the increasing beam deflection angle, and the undeflected electron beams are vertically focused and horizontally diverged by the electrostatic quadrupole lens formed between the opposing portions of the second focus sub-electrode 44 and the third focus sub-electrode 45 and produce horizontally elongated beam spots. Therefore the electron gun of FIG. 4 requires the main lens portion to exert an astigmatic lens action on the electron beams to produce the vertically elongated cross section of the electron beams. The main lens which satisfies the above requirement of the present invention has a vertical main lens diameter larger than its horizontal main lens diameter and facilitates production of the astigmatic lens action to provide the vertically elongated cross section of the electron beams.

Figure 5:
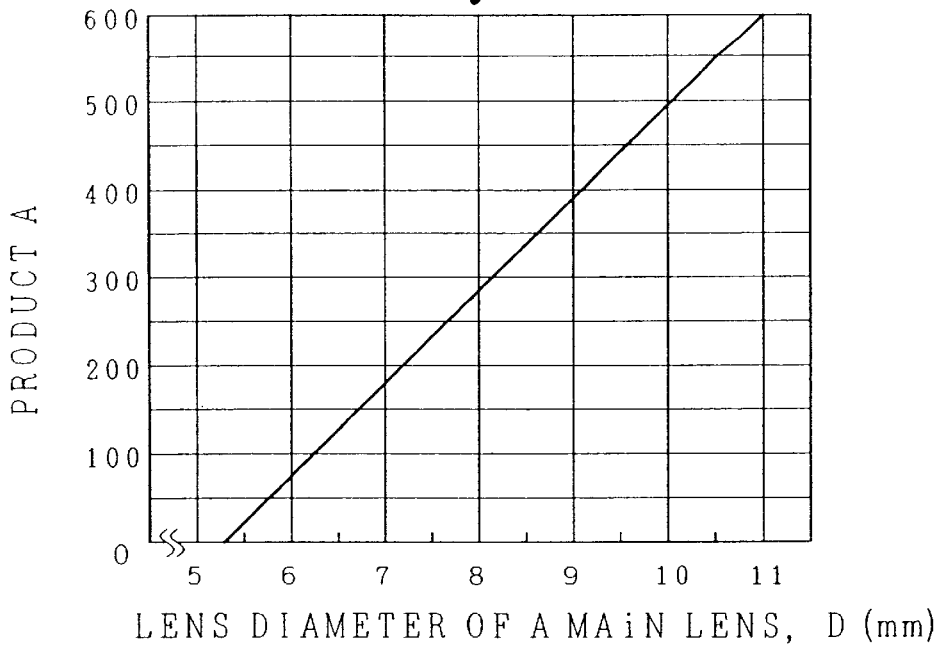
FIG. 5 is a graph showing the relationship between the product A in the electron guns employed in the color cathode ray tubes of the present invention, where the product A is defined as the product V1×V2×T and V1 is a vertical diameter of a single opening common for three electron beams and formed in the focus electrode for forming the main lens, V2 is a vertical diameter of the center beam aperture in the plate electrode disposed in the focus electrode and T is an axial distance between the single opening and the plate electrode, and a lens diameter D (mm) of a circular lens equivalent having a substantially same amount of aberration as a lens of the present invention.

FIG. 5 is a graph showing the relationship between the product A in the electron guns employed in the color cathode ray tubes of the present invention, where the product A is defined as the product V1×V2×T, V1 is a vertical diameter of a single opening common for three electron beams and formed in the focus electrode for forming the main lens, V2 is a vertical diameter of the center beam aperture in the plate electrode disposed in the focus electrode and T is an axial distance between the single opening and the plate electrode, and a lens diameter D (mm) of a circular lens equivalent having a substantially same amount of aberration as a lens of the present invention.

FIG. 5 indicates the effective vertical main lens diameter Dv becomes approximately 10 mm when A=500 as in the first embodiment. The product A is linearly related to the diameter of the main lens limited by the inside diameter of the neck portion of a color cathode ray tube as indicated in FIG. 5.

By designing the dimensions of the electrodes of the main lens so as to satisfy the above relationship, focusing of the electron beams is easily optimized in the horizontal and vertical diameters of the electron beam spots and the resolution can be effectively improved.

As explained above, by solving the problem in that the maximum lens diameter of the main lens is limited by the smaller one of the maximum allowable horizontal and vertical lens diameters of the main lens which are limited by the horizontal or vertical dimension of the structure of the electron gun housed in the neck portion of the cathode ray tube, and consequently making possible reduction of the vertical diameter of the beam spot and facilitation of the optimization of both horizontal and vertical focusing of the electron beam, the present invention can provide the color cathode ray tube having a high resolution improved more effectively.

What is claimed is:

1. A color cathode ray tube comprising:

an evacuated envelope comprising a panel portion, a neck portion and a funnel portion for connecting said panel portion and said neck portion;

a three-color phosphor screen formed on an inner surface of said panel portion;

a shadow mask having a multiplicity of apertures therein and spaced from said phosphor screen;

a three-beam in-line type electron gun housed in said neck portion;

said three-beam in-line type electron gun including an electron beam generating section for generating three electron beams and a main lens section for focusing said three electron beams on said three-color phosphor screen; and a deflecting device mounted in a vicinity of a transition region between said funnel portion and said neck portion for scanning said three electron beams on said three-color phosphor screen;

said main lens section comprising a focus electrode and an anode facing said focus electrode;

wherein said main lens section comprises a focus electrode and an anode facing said focus electrode, said focus electrode being composed of plural focus electrodes;

each of said anode and a first one of said focus sub-electrodes facing said anode comprises a first electrode member having a single opening common for said three electron beams in an end thereof facing another of said anode and said first one of said focus sub-electrodes, and a second electrode member set back from said end of said first electrode member for forming three beam apertures for passing said three electron beams, respectively; and a following inequality being satisfied:

$$(A+566)/106>H-2\times S;$$

where A is V1×V2×T,

V1 is a vertical diameter of said single opening,

V2 is a vertical diameter of a center one of said three beam apertures,

T is an axial distance between said single opening and said second electrode member, H is a horizontal diameter of said single opening, and S is P×L/Q, where P is a horizontal center-to-center spacing between adjacent phosphor elements at a center of said three-color phosphor screen, Q is an axial spacing between said three-color phosphor screen and said shadow mask at the center of said three-color phosphor screen, and L is an axial distance between said shadow mask and said single opening in said focus electrode member of said first one of said focus sub-electrodes.

2. A color cathode ray tube according to claim 1, wherein said focus sub-electrodes includes a first group of said focus sub-electrodes adapted to be supplied with a first focus voltage and a second group of said focus sub-electrodes adapted to be supplied with a second focus voltage, one of said second group of said focus sub-electrodes faces said anode, said second focus voltage is a fixed voltage superposed with a dynamic voltage varying with deflection of said three electron beams; and at least one electrostatic quadrupole lens is formed between facing ends of one of said first group of said focus sub-electrodes and one of said second group of said focus sub-electrodes facing said one of said first group of said focus sub-electrodes.

3. A color cathode ray tube according to claim 2, wherein at least one electrostatic lens is formed between facing ends of one of said first group of said focus sub-electrodes and one of said second group of said focus sub-electrodes, a focusing strength of said at least one electrostatic lens increasing in horizontal and vertical directions with an increasing difference between said first focus voltage and said second focus voltage for correcting a curvature of an image field.

4. A color cathode ray tube comprising:

an evacuated envelope comprising a panel portion, a neck portion and a funnel portion for connecting said panel portion and said neck portion;

a three-color phosphor screen formed on an inner surface of said panel portion;

a shadow mask having a multiplicity of apertures therein and spaced from said phosphor screen;

a three-beam in-line type electron gun housed in said neck portion;

said three-beam in-line type electron gun including an electron beam generating section for generating three electron beams and a main lens section for focusing said three electron beams on said three-color phosphor screen; and a deflecting device mounted in a vicinity of a transition region between said funnel portion and said neck portion for scanning said three electron beams on said three-color phosphor screen;

wherein said main lens section comprises a focus electrode and an anode facing said focus electrode, said focus electrode being composed of plural focus sub-electrodes each of said anode and a first one of said focus sub-electrodes facing said anode comprises a first electrode member having a single opening common for said three electron beams in an end thereof facing another of said anode and said first one of said focus sub-electrodes, and a second electrode member set back from said end of said first electrode member for forming three beam apertures for passing said three electron beams, respectively;

said focus sub-electrodes include at least one sub-electrode of a first group adapted to be supplied with a first focus voltage and at least one sub-electrode of a second group adapted to be supplied with a second focus voltage;

said second focus voltage being a fixed voltage superposed with a dynamic voltage varying with deflection of said three electron beams;

an electrostatic quadrupole lens is formed between facing ends of one of said at least one sub-electrode of said first group and one of said at least one sub-electrode of said second group facing said one of said at least one sub-electrode of said first group; and a following inequality is satisfied:

$$V1>H-2\times S;$$

where V1 is a vertical diameter of said single opening, H is a horizontal diameter of said single opening, and S is P×L/Q, where P is a horizontal center-to-center spacing between adjacent phosphor elements at a center of said three-color phosphor screen, Q is an axial spacing between said three-color phosphor screen and said shadow mask at the center of said three-color phosphor screen, and L is an axial distance between said shadow mask and said single opening in said first electrode member of said first one of said focus sub-electrodes.

5. A color cathode ray tube according to claim 4, wherein said electrostatic quadrupole lens is configured such that said three electron beams are vertically focused and horizontally diverged when said three electron beams are not deflected.

6. A color cathode ray tube according to claim 4, wherein said at least one sub-electrode of at least one of said first and second groups is plural in number.

7. A color cathode ray tube according to claim 6, wherein an electrostatic lens is formed between facing ends of one of said at least one sub-electrode of said first group and one of said at least one sub-electrode of said second group, and a focusing strength of said electrostatic lens decreases with an increasing deflection angle of said three electron beams for correcting a curvature of an image field.

* * * * *